US008019600B2

(12) United States Patent
Son et al.

(10) Patent No.: US 8,019,600 B2
(45) Date of Patent: Sep. 13, 2011

(54) SPEECH SIGNAL COMPRESSION AND/OR DECOMPRESSION METHOD, MEDIUM, AND APPARATUS

(75) Inventors: Changyong Son, Gyeonggi-do (KR); Hosang Sung, Gyeonggi-do (KR); Hochong Park, Gyeonggi-do (KR); Byounghak Jeong, Seoul (KR); Youngyo Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1080 days.

(21) Appl. No.: 11/128,432

(22) Filed: May 13, 2005

(65) Prior Publication Data

US 2006/0020453 A1 Jan. 26, 2006

(30) Foreign Application Priority Data

May 13, 2004 (KR) ..... 10-2004-0033697

(51) Int. Cl.
*G10L 19/00* (2006.01)
*G10L 19/02* (2006.01)
*G10L 19/14* (2006.01)

(52) U.S. Cl. ..... 704/230; 704/203; 704/205

(58) Field of Classification Search ..... None
See application file for complete search history.

(56) References Cited

U.S. PATENT DOCUMENTS

| | | | | |
|---|---|---|---|---|
| 4,860,355 | A * | 8/1989 | Copperi | 704/213 |
| 5,177,799 | A * | 1/1993 | Naitoh | 704/204 |
| 5,388,181 | A * | 2/1995 | Anderson et al. | 704/200.1 |
| 5,414,795 | A * | 5/1995 | Tsutsui et al. | 704/204 |
| 5,684,920 | A * | 11/1997 | Iwakami et al. | 704/203 |
| 5,752,225 | A | 5/1998 | Fielder | |
| 5,819,215 | A * | 10/1998 | Dobson et al. | 704/230 |
| 5,841,377 | A | 11/1998 | Takamizawa et al. | |
| 6,131,084 | A * | 10/2000 | Hardwick | 704/230 |
| 6,199,037 | B1 | 3/2001 | Hardwick | |
| 2002/0116199 | A1 * | 8/2002 | Wu et al. | 704/500 |

FOREIGN PATENT DOCUMENTS

| | | |
|---|---|---|
| JP | 03-035300 | 2/1991 |
| JP | 08-016192 | 1/1996 |
| JP | 10-020897 | 1/1998 |
| JP | 11-088185 | 3/1999 |
| JP | 11-249699 | 9/1999 |
| JP | 2002-366195 | 12/2002 |

(Continued)

OTHER PUBLICATIONS

Sasaki et al. "Variable Rate Voice Coding System". 1992 IEEE, pp. 364-367.*

(Continued)

*Primary Examiner* — Talivaldis Ivars Smits
*Assistant Examiner* — Jesse Pullias
(74) *Attorney, Agent, or Firm* — Staas & Halsey LLP

(57) ABSTRACT

A speech signal compression and/or decompression method, medium, and apparatus in which the speech signal is transformed into the frequency domain for quantizing and dequantizing information of frequency coefficients. The speech signal compression apparatus includes a transform unit to transform a speech signal into the frequency domain and obtain frequency coefficients, a magnitude quantization unit to transform magnitudes of the frequency coefficients, quantize the transformed magnitudes and obtain magnitude quantization indices, a sign quantization unit to quantize signs of the frequency coefficients and obtain sign quantization indices, and a packetizing unit to generate the magnitude and sign quantization indices as a speech packet.

39 Claims, 8 Drawing Sheets

FOREIGN PATENT DOCUMENTS

| | | |
|---|---|---|
| JP | 2002-368622 | 12/2002 |
| JP | 2003-044077 | 2/2003 |
| KR | 1998-080249 | 11/1998 |
| WO | 90/09064 | 8/1990 |

OTHER PUBLICATIONS

Banister et al. "Quantization Performance in SPIHT and Related Wavelet Image Compression Algorithms". IEEE Signal Processing Letters, vol. 6 No. 5, May 1999, p. 97-99.*

Oktem et al. "Hierarchical Enumerative Coding of DCT Coefficients". 2000 IEEE, pp. 2043-2046.*

Zhou et al. "Error Resilient Scalable Audio Coding (ERSAC) for Mobile Applications". IEEE Workshop on Multimedia Signal Processing 2001, Cannes, France, Oct. 2001.*

Mudugamuwa, D.J., et al., "Optimal Transform for Segmented Parametric Speech Coding," Proceedings of the IEEE, pp. 53-56, May 1998.

Lam, Y.H., et al., "Digital Filtering for Audio Coding," IEEE Colloquium on Digital Filters, pp. 10/1-10/11, Apr. 1998.

Search Report issued by European Patent Office Sep. 29, 2005.

Korean Grounds of Rejection Office Action mailed Oct. 18, 2010 corresponds to Korean Patent Application No. 10-2004-0033697.

Korean Notice of Allowance dated Apr. 26, 2011 corresponds to Korean Patent Application No. 10-2004-0033697.

Japanese Non-Final Rejection dated May 10, 2011 corresponds to Japanese Patent Application No. 2005-141989.

* cited by examiner

SPEECH SIGNAL COMPRESSION AND/OR DECOMPRESSION METHOD, MEDIUM, AND APPARATUS

CROSS-REFERENCE TO RELATED APPLICATIONS

This application claims the benefit of Korean Patent Application No. 10-2004-0033697, filed on May 13, 2004, in the Korean Intellectual Property Office, the disclosure of which is incorporated herein by reference.

BACKGROUND OF THE INVENTION

1. Field of the Invention

Embodiments of the present invention relate to encoding and decoding speech signals, and, more particularly, to speech signal compression and/or decompression methods, media, and apparatuses in which the speech signal is transformed into the frequency domain for quantizing and dequantizing information of frequency coefficients.

2. Description of the Related Art

Currently, there are various techniques for speech signal compression and decompression based on frequency transform. These basic compression techniques typically include implementing a frequency transform module, a band division module, a bit allocation module, and a frequency coefficient quantization module. The frequency transform module receives a speech signal, in a duration unit, and transforms the speech signal into the frequency domain through a single transform procedure to obtain frequency coefficients. The frequency coefficient quantization module individually quantizes the frequency coefficients. If the duration unit for the frequency transform becomes too short, the correlation between speech signals in the time domain cannot be sufficiently used, which results in a reduction in the effect of the frequency transform and lowering quantization efficiency. If the duration unit for the frequency transform becomes too long, changes in the characteristics of the speech signals in the time domain disappear, which results in a reduction in the effect of the frequency transform, lowering quantization efficiency, and increasing time delay and complexity in the compression procedure. In other words, since quantization efficiency depends on the duration unit for the frequency transform, it is difficult to obtain optimal compression performance.

Characteristics of the speech signal continuously vary over time. In particular, a duration having a very stably repeated characteristic and a duration having an irregularly and suddenly varied characteristic both coexist in the speech signal. Accordingly, it becomes necessary to positively take advantage of a time-varying property of the speech signal in the frequency transform procedure, so that the optimal effect of the frequency transform can be always obtained, thereby enhancing the quantization efficiency and achieving high compression performance.

SUMMARY OF THE INVENTION

Embodiments of the present invention include speech signal compression and/or decompression methods, media, and apparatuses in which a speech signal is compressed and/or decompressed in the frequency domain.

Embodiments of the present invention also include speech signal compression and/or decompression methods, media, and apparatuses in which a speech signal is divided into a plurality of short duration units, and frequency transform and quantization are individually and sequentially performed for each of the plurality of short duration units.

Embodiments of the present invention also include speech signal compression and/or decompression methods, media, and apparatuses in which quantization efficiency can be enhanced by two-dimensionally arranging and processing frequency coefficients obtained by frequency transform in a short duration unit to reflect a time-varying property of the speech signal.

Embodiments of the present invention also include speech signal compression and/or decompression methods, media, and apparatuses in which frequency coefficients with a two-dimensional arrangement are two-dimensionally transformed and processed.

Embodiments of the present invention also include speech signal compression and/or decompression methods, media, and apparatuses in which the optimum transform results can be obtained by adjusting a type of two-dimensional transform according to characteristics of the speech signal, when two-dimensional frequency coefficients are two-dimensionally transformed.

Embodiments of the present invention also include speech signal compression and/or decompression methods, media, and apparatuses in which magnitudes and signs of frequency coefficients are separately quantized in quantizing the frequency coefficients.

According to an aspect of the present invention, there is provided a speech signal compression apparatus including a transform unit to transform a speech signal into a frequency domain and obtain frequency coefficients, a magnitude quantization unit to transform magnitudes of the frequency coefficients, quantize the transformed magnitudes and obtain magnitude quantization indices, a sign quantization unit to quantize signs of the frequency coefficients and obtain signs quantization indices, and a packetizing unit to generate the magnitude and signs quantization indices as a speech packet.

According to another aspect of the present invention, there is provided a speech signal decompression apparatus including an inverse packetizing unit to inversely packetize a compressed speech packet and obtain sign quantization indices and magnitude quantization indices, a sign dequantizer to dequantize the sign quantization indices and coefficient signs, a magnitude dequantizer to dequantize the magnitude quantization indices and obtain first coefficient magnitudes, a two-dimensional arrangement unit to two-dimensionally arrange the first coefficient magnitudes and obtain second coefficient magnitudes, a first inverse transformer to inversely transform the second coefficient magnitudes and obtain third coefficient magnitudes, a sign insertion unit to insert signs into the third coefficient magnitudes and obtain frequency coefficients, a subframe divider to divide the frequency coefficients into a plurality of subframes, and a second inverse transformer to inversely transform the frequency coefficients and obtain a time domain signal, for each of the subframes.

According to still another aspect of the present invention, there is provided a speech signal compression method including transforming a speech signal into a frequency domain to obtain frequency coefficients, transforming magnitudes of the frequency coefficients and quantizing the transformed magnitudes to obtain magnitude quantization indices, quantizing signs of the frequency coefficients to obtain signs quantization indices, and generating the magnitude and signs quantization indices as a speech packet.

According to yet still another aspect of the present invention, there is provided a speech signal decompression method including inversely packetizing a compressed speech packet to obtain sign quantization indices and magnitude quantization indices, dequantizing the sign quantization indices and coefficient signs, dequantizing the magnitude quantization indices to obtain first coefficient magnitudes, two-dimensionally arranging the first coefficient magnitudes to obtain second coefficient magnitudes, inversely transforming the second coefficient magnitudes to obtain third coefficient magnitudes, inserting signs into the third coefficient magnitudes to obtain frequency coefficients, dividing the frequency coefficients into a plurality of subframes, and inversely transforming the frequency coefficients to obtain a time domain signal, for each of the subframes.

According to a further aspect of the present invention, there is provided a medium comprising computer-readable code implementing embodiments of the present invention.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
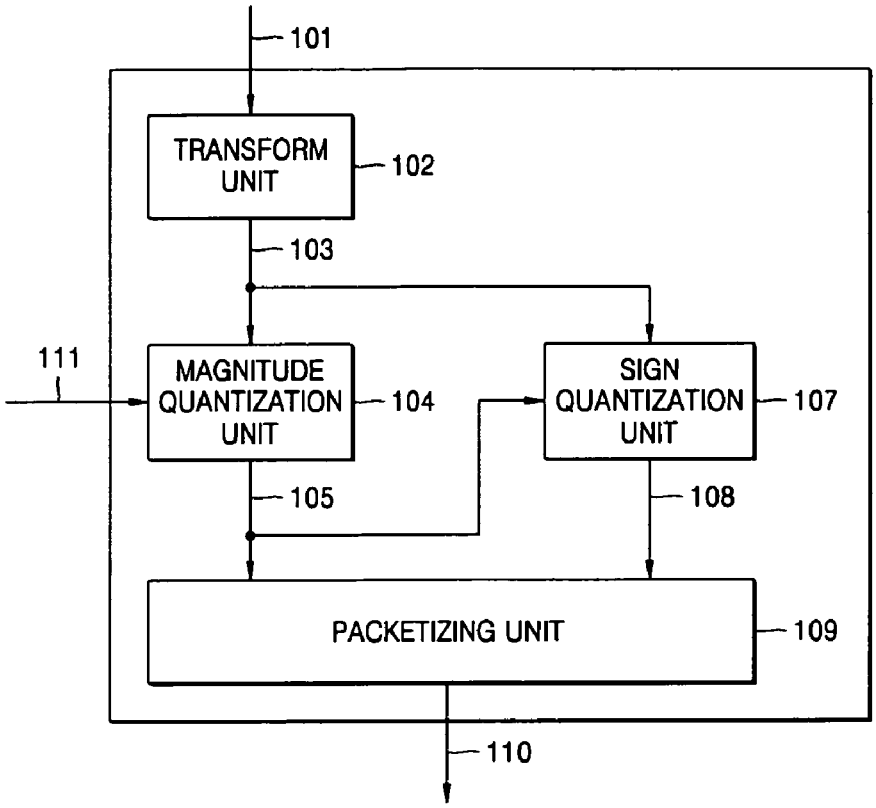
FIG. 1 is a block diagram of a speech signal compression apparatus, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Speech signal compression and decompression methods, media, and apparatuses, according to an embodiment of the present invention, may also be implemented independently in a compressor or decompressor, as well as in portions of a speech encoder and decoder, and may compress and decompress various types of speech signals. As an example, the speech signals may include an original speech signal having various bandwidths such as a narrow-band or a wide-band, a band-pass filtered speech signal limited to a specified frequency band, a preprocessed speech signal obtained by applying various preprocessing to the original speech signal, etc. These speech signals may be compressed and/or decompressed through similar operations, based on the disclosure the present invention. In one embodiment, a wide-band speech signal may be sampled at 16 kHz and divided into both a low-band signal and a high-band signal, with the high-band signal being applied as an input of the speech signal compression and decompression. At this time, information calculated during compression of the low-band signal, in another module for processing the low-band signal, can be transferred to the speech signal compression and decompression apparatus.

FIG. 1 is a block diagram of a speech signal compression apparatus, according to an embodiment of the present invention. Referring to FIG. 1, the speech signal compression apparatus may include a transform unit 102, a magnitude quantization unit 104, a sign quantization unit 107, and a packetizing unit 109.

The transform unit 102 receives a speech signal 101 divided into a plurality of frames, transforms one frame of the speech signal 101 into the frequency domain, and outputs frequency coefficients 103.

The magnitude quantization unit 104 quantizes magnitudes, e.g. absolute values, of the frequency coefficients 103 obtained from the transform unit 102, and outputs magnitude quantization indices 105. The magnitude quantization unit 104 may use some additional information 111 about the speech signal 101, which is obtained by another module.

The sign quantization unit 107 quantizes signs of the frequency coefficients 103 obtained from the transform unit 102, and outputs sign quantization indices 108. The sign quantization unit 107 may take advantage of the magnitude quantization indices 105 provided from the magnitude quantization unit 104.

The packetizing unit 109 receives the magnitude and the sign quantization indices 105 and 108 for one frame of the speech signal 101, generates a speech packet 110 with a predefined format, and transmits the speech packet 110 via a transmission line (not shown).

Figure 2:
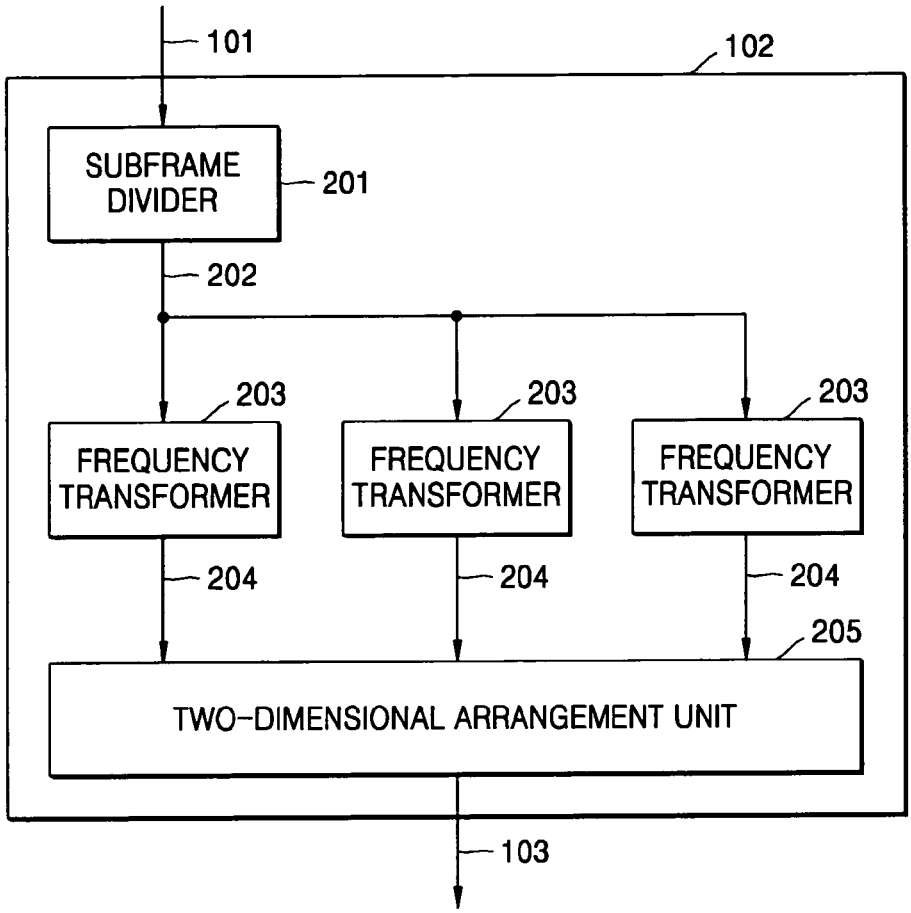
FIG. 2 is a detailed block diagram for a transform unit, e.g., as shown in FIG. 1, according to an embodiment of the present invention.

FIG. 2 is a detailed block diagram for the transform unit 102, as shown in FIG. 1. Referring to FIG. 2, the transform unit 102 includes a subframe divider 201, a plurality of frequency transformers 203, and a two-dimensional arrangement unit 205.

The subframe divider 201 divides one frame of the speech signal 101 into a plurality of subframe signals 202.

Each of the plurality of frequency transformers 203 individually receive one of the plurality of subframe signals 202, and thereby transform each of the plurality of subframe signals 202 into the frequency domain to output respective frequency coefficients 204.

The two-dimensional arrangement unit 205 receives the frequency coefficients 204, obtained for all subframe signals 202, two-dimensionally arranges the frequency coefficients 204, and outputs the frequency coefficients 103 with a two-dimensional arrangement. Frequency coefficients corresponding to a first subframe can be represented as freq[0][k], frequency coefficients corresponding to a second subframe can be represented as freq[1][k], and frequency coefficients corresponding to a last subframe can be represented as freq [N−1][k], where k has a value from 0 to M−1, N denotes the number of subframes, and M denotes the number of samples included in one subframe. Consequently, the frequency coefficients 103 may be represented as the two-dimensional arrangement having the size N×M. In other words, in freq

[subframe][k], an index 'subframe' reflects a time-varying property of the speech signal 101 and an index 'k' corresponds to a frequency index.

In one embodiment, one frame may have a size of 30 msec, and the subframe divider 201 may divide one frame of the speech signal into six subframes each having sizes of 5 msec, and output six subframe signals 202. The frequency transform can be separately performed, for each of the six subframe signals 202, to output the respective frequency coefficients 204. Accordingly, in this two-dimensional arrangement, N becomes 6 and M becomes 40. If a frequency band to be used ranges from 4 kHz to 8 kHz, k equaling 0 corresponds to 4 kHz, in the frequency coefficients 103 with the two-dimensional arrangement, i.e., freq[subframe][k], and the corresponding frequency would be increased by 100 Hz upon each incrementing of k by 1.

The plurality of frequency transformers 203 may use various types of well known mathematical methods. In one embodiment, each of the plurality of frequency transformers 203 may take advantage of the Modulated Lapped Transform (MLT). MLT coefficients regarding a speech signal may be obtained in existing various manners.

Figure 3:
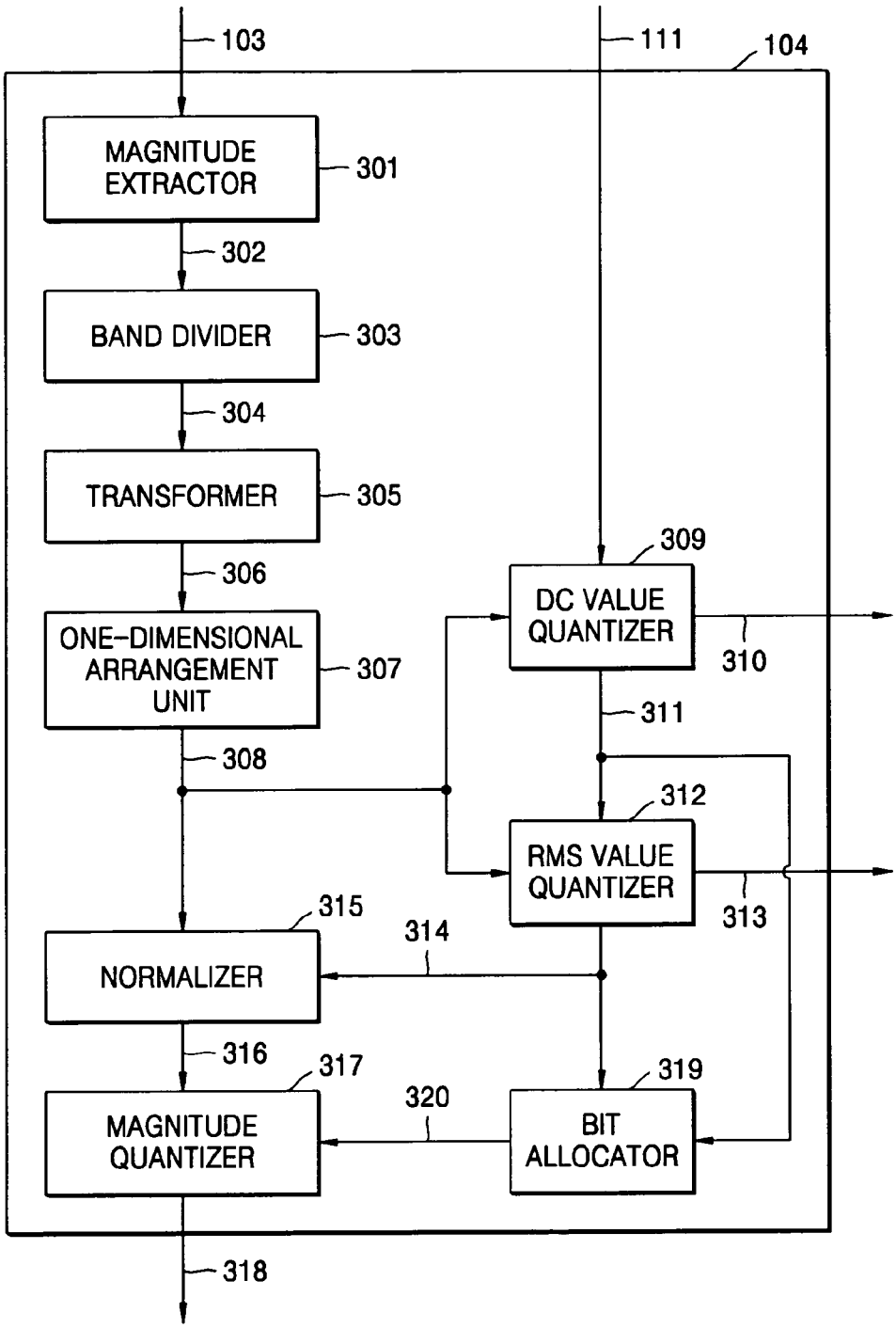
FIG. 3 is a detailed block diagram for a magnitude quantization unit, e.g., as shown in FIG. 1, according to an embodiment of the present invention.

FIG. 3 is a detailed block diagram for the magnitude quantization unit 104 shown in FIG. 1. Referring to FIG. 3, the magnitude quantization unit 104 may include a magnitude extractor 301, a band divider 303, a transformer 305, a one-dimensional arrangement unit 307, a Direct Current (DC) value quantizer 309, a Root-Mean-Square (RMS) value quantizer 312, a normalizer 315, a magnitude quantizer 317, and a bit allocator 319.

The magnitude extractor 301 receives the frequency coefficients 103, with a two-dimensional arrangement, and extracts first coefficient magnitudes 302 with the two-dimensional arrangement.

The band divider 303 receives the first coefficient magnitudes 302 with the two-dimensional arrangement, and divides the first coefficient magnitudes 302 into a plurality of frequency bands to output second coefficient magnitudes 304, with a three-dimensional arrangement for each of the frequency bands. The second coefficient magnitudes 304 can be represented as freq_mag[band][subframe][k], where an index 'band' denotes a frequency band, an index 'subframe' denotes a subframe, an index 'k' denotes a frequency index for each of the frequency bands, and the range of k is determined based on a division type of the band divider 303. For simplicity of explanation, operations on a single frequency band will be described hereinafter. Meanwhile, the second coefficient magnitudes 304 have a two-dimensional arrangement, as the index 'band' has a fixed value, if the second coefficient magnitudes 304 are individually explained either for each of the frequency bands or for a single frequency band. Accordingly, it will be assumed herein that the second coefficient magnitudes 304 have a two-dimensional arrangement, with the number of the subframes being N, and each of the frequency bands having P frequency coefficients. The number of frequency coefficients may be different from each other for each of the frequency bands according to an operation of the band divider 303. For simplicity of explanation, however, it is assumed herein that each of the frequency bands has P frequency coefficients. Even if the number of the frequency coefficients differs from each other for each of the frequency bands, the same structure and operation may be applied. Accordingly, the second coefficient magnitudes 304 have the two-dimensional arrangement with the size N×M in which the index 'subframe' and the index 'frequency' form a time axis and a frequency axis, respectively.

The transformer 305 divides the second coefficient magnitudes 304 into a plurality of two-dimensional arrangements, and two-dimensionally transforms each of the plurality of two-dimensional arrangements to output a plurality of third coefficient magnitudes 306. The operation of the transformer 305 will be explained in more detail with reference to FIGS. 8A through 8C.

Figure 8A:
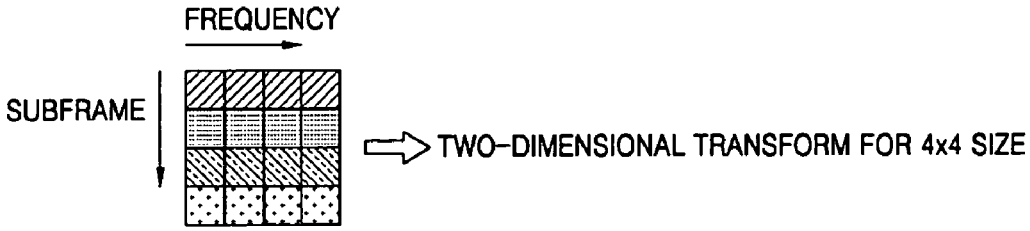
FIGS. 8A through 8C show examples of division performed in different ways in a transformer, e.g., as shown in FIG. 3, according to embodiments of the present invention.
Figure 8B:
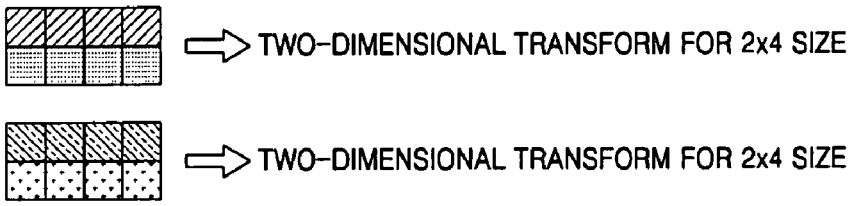
Figure 8C:
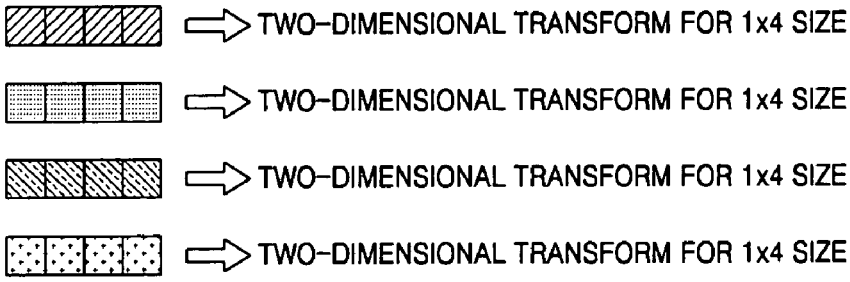

FIGS. 8A through 8C show some examples of division performed in a different ways, for the transformer 305 of FIG. 3. FIG. 8A shows the second coefficient magnitudes with the two-dimensional arrangement in a specified frequency band, where each of the cells represents corresponding second coefficient magnitudes, with N and P having a value of 4. It is assumed herein that N subframes exist in a single frame. In order to combine the N subframes into a single group, a transform is performed for the size N×P so as to obtain the third coefficient magnitudes with the size N×P, as shown in FIG. 8A. In order to combine the N subframes into two groups, the transform is separately performed for both the size 2×P and the size (N−2)×P so as to obtain the third coefficient magnitudes, with a corresponding size 2×P, and the third coefficient magnitudes, with a corresponding size (N−2)×P, as shown in FIG. 8B. Further, in order to combine the N subframes into N groups, the transform is performed for the size 1×P, as much as N times, so as to obtain N number of the third coefficient magnitudes with the size 1×P, as shown in FIG. 8C, for example.

In order to take advantage of the correlations between subframes, an embodiment method includes similarly combining the second coefficient magnitudes into at least one group, where at least one subframe is included, for each of the frequency bands, throughout entire frames. Otherwise, the method of combining the second coefficient magnitudes into at least one group may be variably determined according to characteristics of the speech signal 101, such as based on a time-varying property in energy. A standard for determining the type of groups may be determined by using existing various manners according to the characteristics of the speech signal 101.

Hereinafter, as shown in FIG. 8A, it is assumed that the entire N subframes are combined into a single group and a two-dimensional transform is performed once on the size N×P. Meanwhile, even if the entire N subframes are combined into at least two groups, as shown in FIGS. 8B and 8C, the same procedure based on a similar operation and concept may be applied to each of groups so that the third coefficient magnitudes can be separately quantized, for each of the groups.

The transformer 305 performs the two-dimensional transform once on a single group having the size N×P and outputs the third coefficient magnitudes having the size N×P, for each of the frequency bands, which can be represented as dct[band][n][m]. Through the two-dimensional transform in the transformer 305, correlation between the time axis and the frequency axis can be simultaneously considered so that energy dispersed over the two-dimensional arrangement of freq_mag[band][subframe][k] can be compacted in a small region, for each of the frequency bands. In other words, more energy can be compacted in a region at which both n and m have a smaller value among the third coefficient magnitudes dct[band][n][m] having the size N×P, for each of the frequency bands.

In one embodiment, the transformer 305 may also use a two-dimensional Discrete Cosine Transform (DCT).

The one-dimensional arrangement unit 307, as shown in FIG. 3, one-dimensionally arranges the third coefficient magnitudes 306 so as to output fourth coefficient magnitudes 308, for each of the frequency bands. The one-dimensional arrangement unit 307 arranges the third coefficient magnitudes 306, i.e. dct[band][n][m] having the size N×P into the fourth coefficient magnitudes 308 having the length N×P, based on a predefined arrangement rule. The fourth coefficient magnitudes for each of the frequency bands can be represented as dct_1[band][p]. The one-dimensional arrangement unit 307 performs an operation of simply converting a two-dimensional arrangement into a one-dimensional arrangement. Accordingly, values of the coefficient magnitudes may not be changed. An example of one arrangement rule used in the one-dimensional arrangement unit 307 is described as follows.

The one-dimensional arrangement unit 307 one-dimensionally arranges the third coefficient magnitudes 306, i.e. dct[band][n][m] in an ascending order of average energy, so as to output the fourth coefficient magnitudes 308, for each of the frequency bands. For this, the average energy can be obtained for each position in the size N×P of the third coefficient magnitudes 306 in advance, e.g., through experiments and/or simulations. The arrangement rule used in the one-dimensional arrangement unit 307 may be predetermined at an initial stage during designing of the corresponding compressor, or one of a plurality of arrangement rules may be selected and used according to characteristics of the speech signal. Also, since both a compressor and a decompressor may have the same arrangement rule, arrangement conversion between dct[band][n][m] and dct_1[band][p] may be defined without any additional information. Generally, since a position at which both n and m have a value of 0 has the greatest average energy in dct[band][n][m], dct[band][0][0] corresponds to dct_1[band][0].

The DC value quantizer 309 quantizes the first index dct_1[band][0] corresponding to a DC value among the fourth coefficient magnitudes 308 so as to output a DC quantization index 301 and a quantized DC value 311. The DC value quantizer 309 may collect all the DC values for all frequency bands to take advantage of correlation between the DC values of adjacent frequency bands. In one embodiment, the DC value quantizer 309 may use energy information 111 of a low-band signal calculated during compression of the low-band signal. In addition, gains of quantized fixed codebooks for the low-band signal may used as the energy information 111, if the low-band signal is processed through a Code Exited Linear Prediction (CELP) type compressor.

The RMS value quantizer 312 can calculate RMS values of the remaining coefficient magnitudes, i.e. from dct_1[band][1] to dct_1[band][N×P−1] other than the DC value among the fourth coefficient magnitudes and quantizes the RMS values so as to output RMS quantization indices 313 and quantized RMS values 314, for each of the frequency bands. Since RMS values have a high correlation with a DC value in a specified frequency band, such a property may be used in quantizing the RMS values. Simultaneously, correlation between the RMS values for each of the frequency bands may be used. In one embodiment, the RMS values can be predicted from the quantized DC value 311 to then be quantized.

The normalizer 315 normalizes the fourth coefficient magnitudes 308 using the quantized RMS values 314 so as to output fifth coefficient magnitudes 316, for each of the frequency bands. The normalizer 315 normalizes the remaining coefficient magnitudes other than the DC value among the fourth coefficient magnitudes 308, since the DC value has been quantized in the DC value quantizer 309. The fifth coefficient magnitudes 316 can be represented as dct_norm[band][p]. Generally, the normalizer 315 obtains the fifth coefficient magnitudes 316 by dividing the fourth coefficient magnitudes 308 by the quantized RMS values, for each of the frequency bands.

The magnitude quantizer 317 individually quantizes the fifth coefficient magnitudes 316 so as to output magnitude quantization indices 318, for each of the frequency bands. The magnitude quantizer 317 may perform Vector Quantization on the fifth coefficient magnitudes 316. The Vector Quantization may be implemented by a SVQ (Split Vector Quantization), depending on complexity and memory capacity.

The bit allocator 319 determines and outputs bit allocation information for the magnitude quantizer 317. For this, the bit allocator 319 analyzes characteristics of each of the frequency bands so as to determine the number of bits allocated to each of the frequency bands. If the magnitude quantizer 317 performs the SVQ, the number of bits allocated to subvectors split in each of the frequency bands can be determined.

In one embodiment, a bit allocation rule is used where more bits are allocated to subvectors having a smaller value of the index 'p' among dct_norm[band][p], and null bit, i.e. 0 (zero) bit, is allocated to some specified subvectors not to be transmitted, for each of the frequency bands. This is because most of average energy of the fourth coefficient magnitudes 308 exists in indices having a smaller p value, and the average energy of the fourth coefficient magnitudes 308 does not exist in indices having a greater p value, by the arrangement conversion in the one-dimensional arrangement unit 307. Alternately, smaller bits can be allocated to some frequency bands having a low priority, based on the priorities of the frequency bands. The priorities of the frequency bands may be determined using the quantized DC value 311 and the quantized RMS values 314.

The DC quantization index 310, the RMS quantization indices 313, and the magnitude quantization indices 318 correspond to the magnitude quantization indices 105 provided from the magnitude quantization unit 104.

In one embodiment, information relevant to 7 kHz among the entire frequency band, 8 kHz for the high-band signal, is transmitted. Accordingly, information of frequency coefficients corresponding to 7 kHz, i.e. coefficient magnitudes from freq_mag[subframe][0] to freq_mag[subframe][29] are quantized. In addition, the frequency band ranging from 4 kHz to 7 kHz is divided into five frequency bands each having 600 Hz bandwidth. For each of the frequency bands, the size of the third coefficient magnitudes 306 is 6×6, the length of the fourth coefficient magnitudes 308 is 36, and the number of coefficient magnitudes to be actually quantized among the fourth coefficient magnitudes 308 is 35. In such a case, examples of a split structure for the SVQ and the number of bits allocated to subvectors based on the priorities of the frequency bands may be defined below in Table 1.

TABLE 1

| BAND | LENGTH OF SUBVECTORS | | | | | |
|---|---|---|---|---|---|---|
| PRIORITY | 5-DIM | 6-DIM | 8-DIM | 8-DIM | 8-DIM | TOTAL |
| 1 | 9 | 9 | 7 | 6 | 5 | 36 |
| 2 | 8 | 8 | 5 | 4 | 3 | 28 |
| 3 | 7 | 7 | 4 | 3 | 0 | 21 |
| 4 | 6 | 3 | 2 | 0 | 0 | 11 |
| 5 | 5 | 2 | 0 | 0 | 0 | 7 |
| THE NUMBER OF ALLOCATED BITS | | | | | | 103 |

Figure 4:
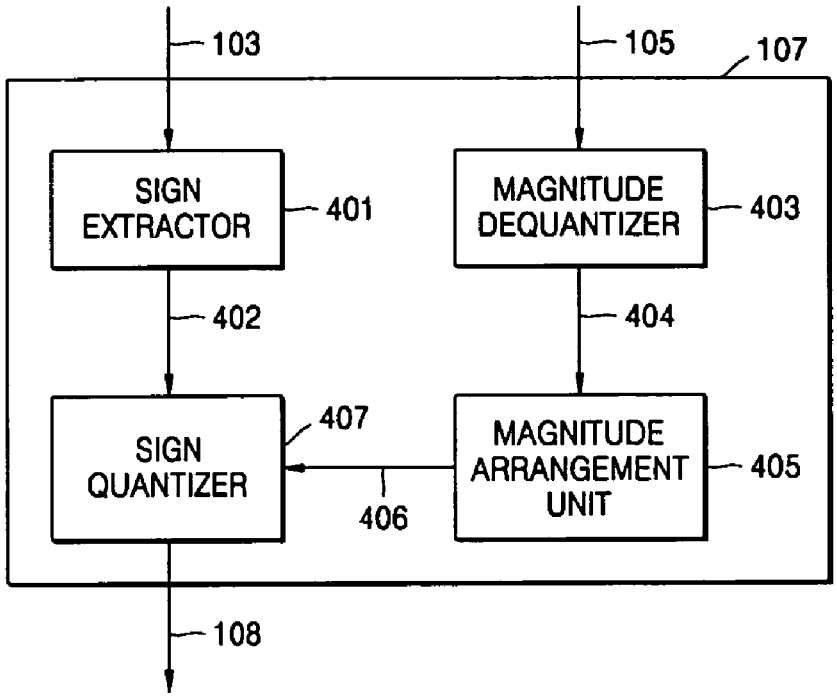
FIG. 4 is a detailed block diagram for a sign quantization unit, e.g., as shown in FIG. 1, according to an embodiment of the present invention.

FIG. 4 is a detailed block diagram for the sign quantization unit 107 shown in FIG. 1. Referring to FIG. 4, the sign quantization unit 107 includes a sign extractor 401, a magnitude dequantizer 403, a magnitude arrangement unit 405, and a sign quantizer 407.

The sign extractor 401 extracts signs from the frequency coefficients 103 to output coefficient signs 402.

The magnitude dequantizer 403 dequantizes the magnitude quantization indices 103, provided from the magnitude quantization unit 104, for each parameter to output coefficient magnitudes 404. The detailed operation of the magnitude dequantizer 403 is defined by the magnitude quantization unit 104 and may be performed in existing various manners.

The magnitude arrangement unit 405 receives the coefficient magnitudes 404 and arranges them in an ascending order of magnitudes to output magnitude order information 406. The magnitude order information 406 indicates an order in which a value of coefficient magnitudes places in the coefficient magnitudes 404.

The sign quantizer 407 selects coefficient magnitudes, up to a predetermined number, for example, from the coefficient magnitudes 404 based on the magnitude order information 406. The selected coefficient magnitudes have values greater than not-selected coefficient magnitudes among the coefficient magnitudes 404. The sign quantizer 407 quantizes signs corresponding to the selected coefficient magnitudes to output the sign quantization indices 108.

In one embodiment, the sign quantizer 407 quantizes each of the signs with 1 bit, the number of the coefficient magnitudes 404 is 180, the number of actually quantized and transmitted signs is 92, and 88 of the coefficient magnitudes 404 are not quantized and not transmitted.

Figure 5:
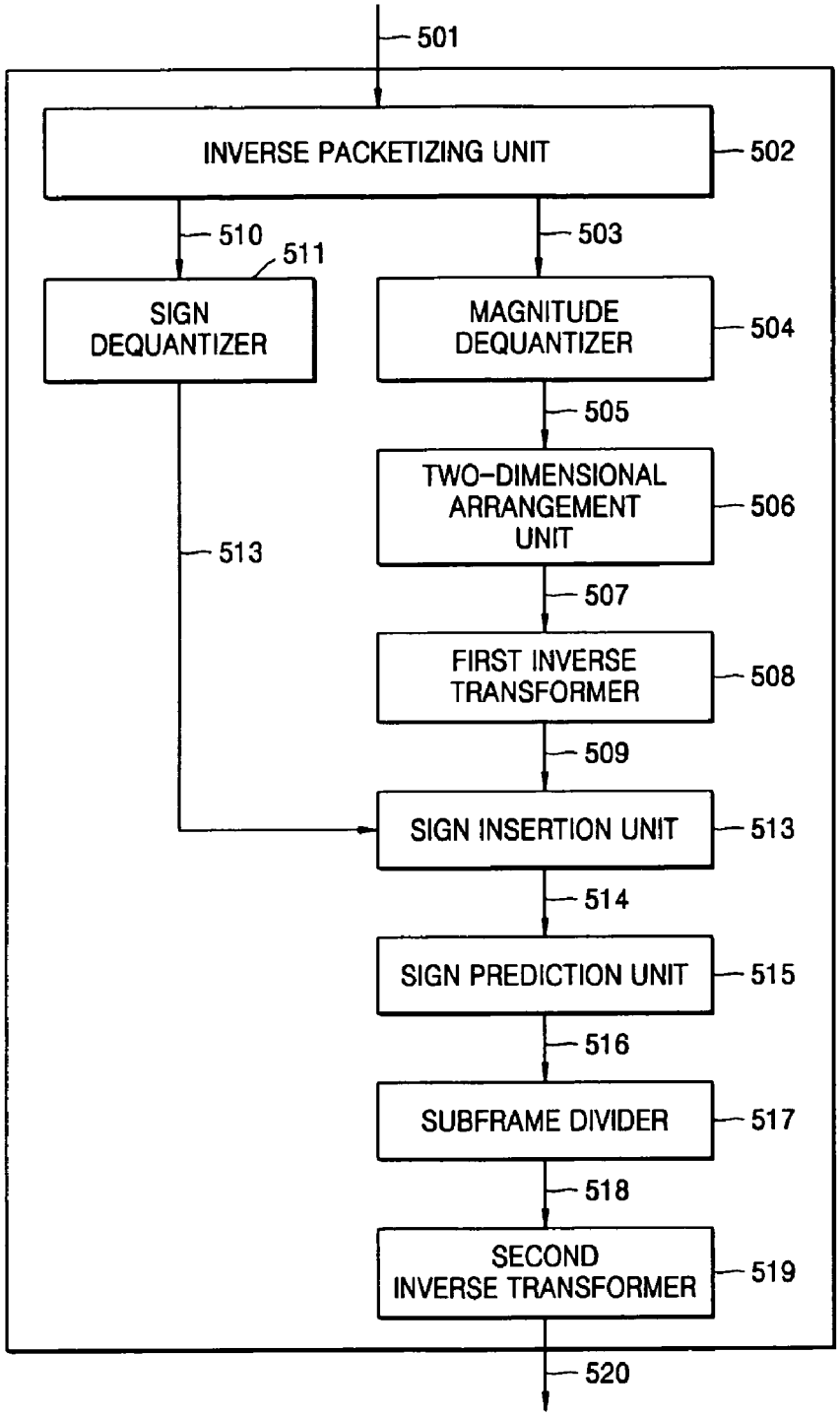
FIG. 5 is a block diagram of a speech signal decompression apparatus, according to an embodiment of the present invention.

FIG. 5 is a block diagram of a speech signal decompression apparatus, according to an embodiment of the present invention. Referring to FIG. 5, the speech signal decompression apparatus may include an inverse packetizing unit 502, a magnitude dequantizer 504, a two-dimensional arrangement unit 506, a first inverse transformer 508, a sign dequantizer 511, a sign insertion unit 513, a sign prediction unit 515, a subframe divider 517, and a second inverse transformer 519.

The inverse packetizing unit 502 receives a speech packet 501 via a transmission line (not shown) to be inversely packetized, so as to output magnitude quantization indices 503 and sign quantization indices 510.

The magnitude dequantizer 504 dequantizes the magnitude quantization indices 503 so as to output first coefficient magnitudes 505. The detailed operation of the magnitude dequantizer 504 is similar to the magnitude quantization unit 104 and the first coefficient magnitudes 505 similarly correspond to quantized values of the fourth coefficient magnitudes 308 shown FIG. 3.

The two-dimensional arrangement unit 506 two-dimensionally arranges the first coefficient magnitudes 505 so as to output second coefficient magnitudes 507. The two-dimensional arrangement unit 506 similarly performs an inverse operation of the one-dimensional arrangement unit 307 shown in FIG. 3.

The first inverse transformer 508 performs a two-dimensional inverse transform on the second coefficient magnitudes 507 so as to output third coefficient magnitudes 509. The first inverse transformer 508 similarly performs an inverse operation of the transformer 305 shown in FIG. 3.

The sign dequantizer 511 dequantizes the sign quantization indices 510 so as to output coefficient signs 512.

The sign insertion unit 513 inserts the coefficient signs 512 into the third coefficient magnitudes 509 so as to output frequency coefficients 514.

The sign prediction unit 515 predicts signs, so as to output the final frequency coefficients 516 by reflecting the predicted signs, if some signs are not transformed from the sign quantization unit 107. In one embodiment, the sign prediction unit 515 may predict signs so that discontinuity of the boundary between frames can be minimized for each of frequency components whose signs are not transmitted. In another embodiment, the sign prediction unit 515 may irregularly and arbitrarily determine signs not transformed from the sign quantization unit 107.

The subframe divider 517 receives the frequency coefficients 516 with a two-dimensional arrangement and divides the frequency coefficients 516 into a plurality of subframes to output frequency coefficients 518 for each of the subframes.

The second inverse transformer 519 receives the frequency coefficients 518 and performs an inverse frequency transform on the frequency coefficients 518 to output a time domain signal 520, for each of the subframes. The second inverse transformer 519 similarly performs an inverse operation of the transform unit 102 shown in FIG. 1.

Figure 6:
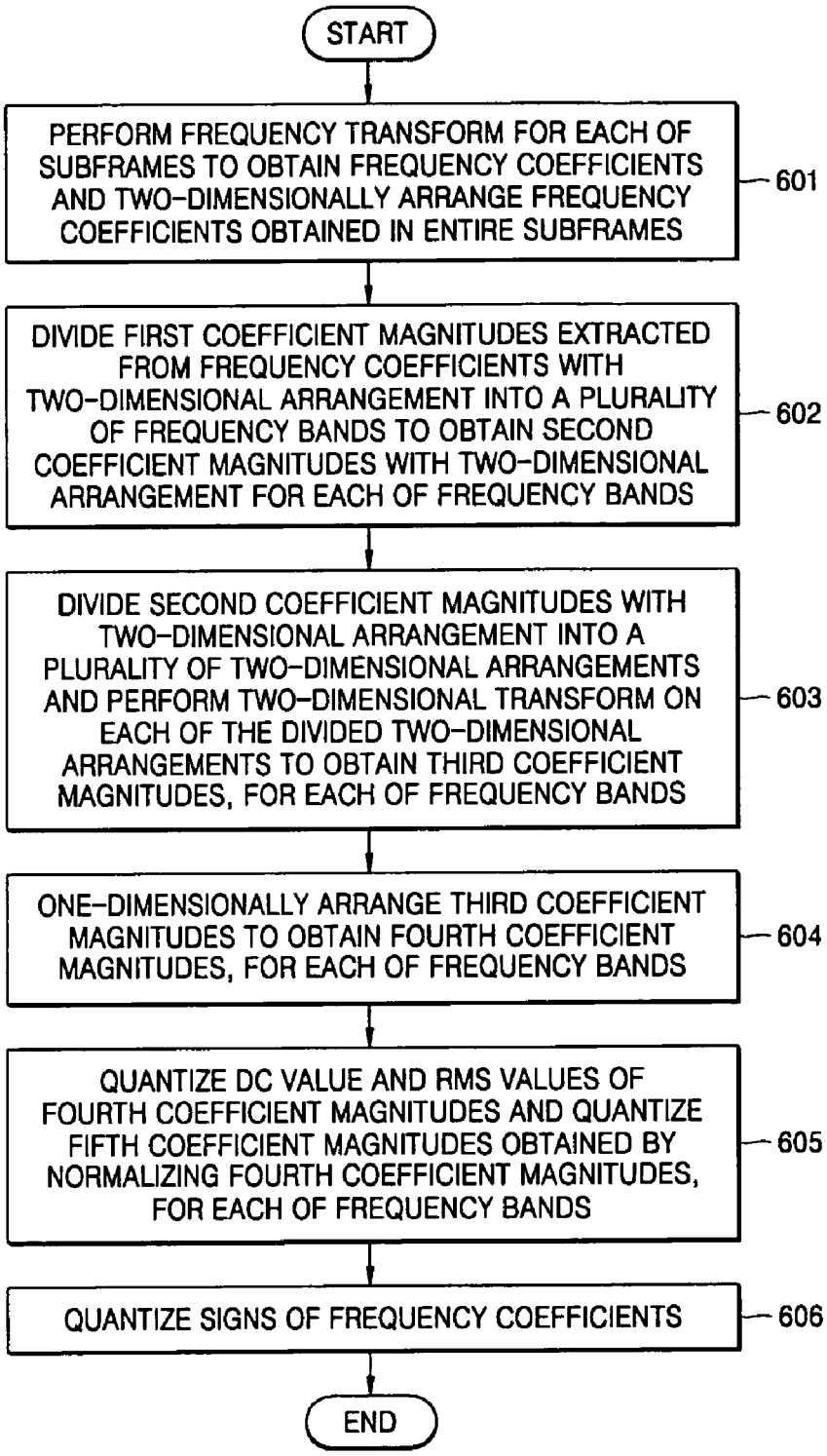
FIG. 6 is a flowchart illustrating an operation of a speech signal compression method, according to an embodiment of the present invention.

FIG. 6 is a flowchart illustrating an operation of a speech signal compression method, according to an embodiment of the present invention.

Referring to FIG. 6, in operation 601, a speech signal 101 is divided into a plurality of subframes using as subframe divider, as shown in FIG. 2, a frequency transform is performed for each of the subframes, as shown in FIG. 3, so as to obtain frequency coefficients 103 with a two-dimensional arrangement.

In operation 602, first coefficient magnitudes 302 are extracted from the frequency coefficients 103 with the two-dimensional arrangement, the first coefficient magnitudes 302 are divided into a plurality of frequency bands to obtain second coefficient magnitudes 304 with the two-dimensional arrangement, for each of frequency bands, as shown in FIG. 3.

In operation 603, the second coefficient magnitudes 304 with the two-dimensional arrangement are divided into a plurality of two-dimensional arrangements, and two-dimensional transform is performed on each of the divided two-dimensional arrangements to obtain third coefficient magnitudes 306, for each of frequency bands.

In operation 604, the third coefficient magnitudes are one-dimensionally arranged so as to obtain fourth coefficient magnitudes 308, for each of frequency bands.

In operation 605, a DC value and RMS values of the fourth coefficient magnitudes are quantized, and fifth coefficient magnitudes 316, obtained by normalizing the fourth coefficient magnitudes 308, are quantized, for each of the frequency bands.

In operation 606, signs of frequency coefficients 103 are quantized.

Figure 7:
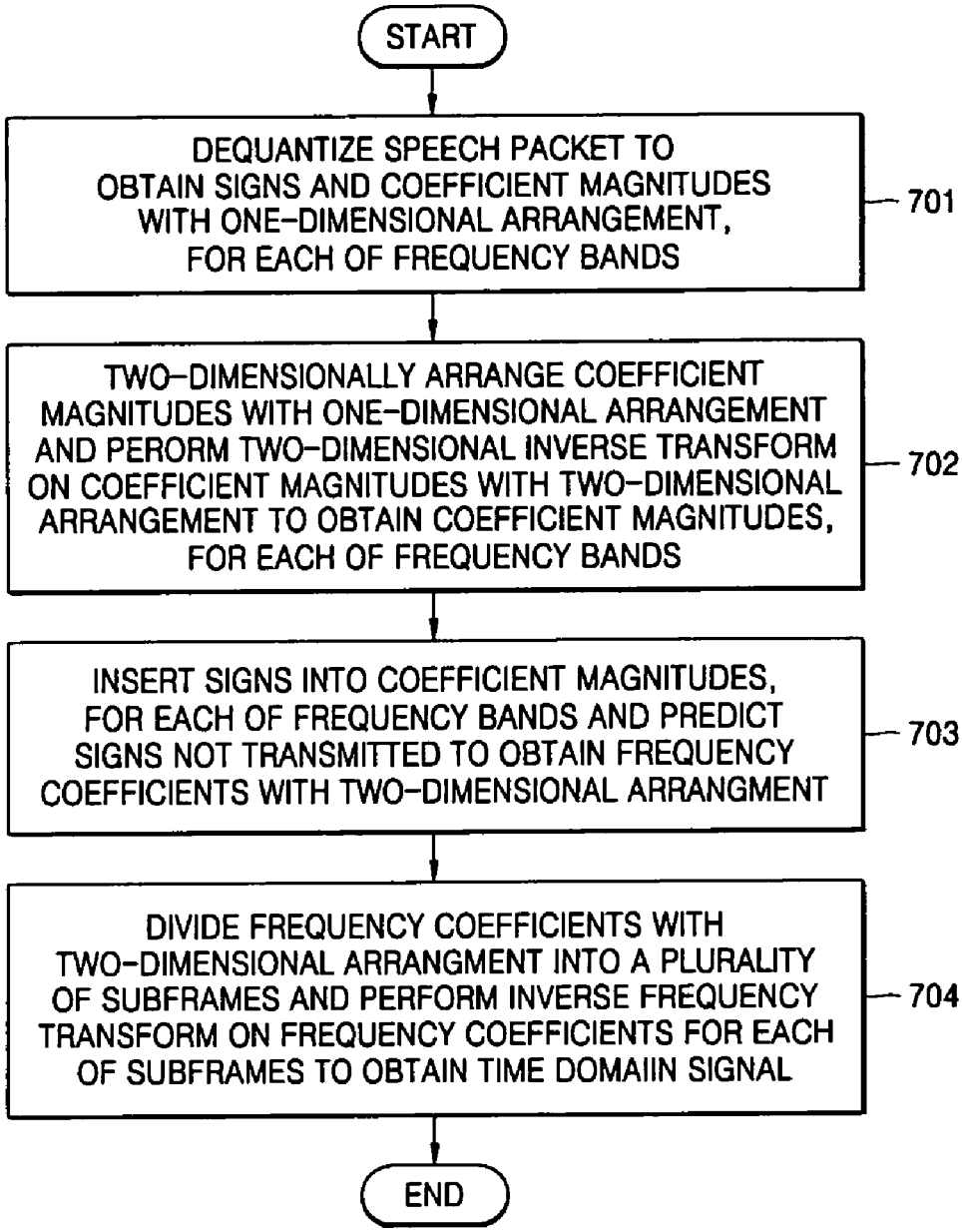
FIG. 7 is a flowchart illustrating an operation of a speech signal decompression method, according to an embodiment of the present invention.

FIG. 7 is a flowchart illustrating an operation of a speech signal decompression method, according to an embodiment of the present invention.

Referring to FIG. 7, in operation 701, a speech packet transmitted via a transmission line (not shown) is dequantized for each of the parameters so as to obtain signs and coefficient magnitudes with a one-dimensional arrangement, for each of the frequency bands.

In operation 702, the coefficient magnitudes with the one-dimensional arrangement are two-dimensionally arranged and a two-dimensional inverse transform is performed on the coefficient magnitudes with a two-dimensional arrangement so as to obtain coefficient magnitudes, for each of frequency bands.

In operation 703, the signs are inserted into the coefficient magnitudes, for each of frequency bands and signs not transmitted via the transmission line are predicted so as to obtain frequency coefficients with a two-dimensional arrangement.

In operation 704, the frequency coefficients with the two-dimensional arrangement are divided into a plurality of subframes and an inverse frequency transform is performed on the frequency coefficients for each of subframes so as to obtain a time domain signal.

Embodiments of the present invention can also be embodied as computer readable code/instructions included in a medium, e.g., on a computer readable recording medium. The medium may be any data storage device that can store/transmit data which can be thereafter read by a computer system. Examples of the medium/media include read-only memory (ROM), random-access memory (RAM), CD-ROMs, magnetic tapes, floppy disks, optical data storage devices, and carrier waves (such as data transmission through the Internet), for example. The medium can also be distributed over network coupled computer systems so that the computer readable code is stored/transmitted and executed in a distributed fashion. Such functional instructions, programs, code, and/or code segments for accomplishing embodiments of the present invention can be easily construed by programmers skilled in the art to which the present invention pertains.

As described above, embodiments of the present invention include a method, medium, and apparatus capable of compressing and/or decompressing a speech signal through frequency transform and quantization of frequency coefficients.

In addition, according to embodiments of the present invention, coefficients useful in quantization can be obtained by performing frequency transform in a short duration unit, two-dimensionally arranging frequency coefficients, and again performing two-dimensional transform on the frequency coefficients with a two-dimensional arrangement.

In addition, according to embodiments of the present invention, quantization efficiency can be enhanced by combining information on a plurality of subframes into various types of groups and performing a proper two-dimensional transform on each group according to characteristics of the speech signal.

In addition, according to embodiments of the present invention, a more efficient quantization can be achieved by separately quantizing magnitudes and signs of frequency coefficients in quantizing the frequency coefficients, selectively quantizing the signs of the frequency coefficients according to the magnitudes of the frequency coefficients, and predicting some signs not transmitted via a transmission line.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A speech signal compression apparatus, including at least one processing device comprising:

a transform unit, using the at least one processing device, to transform a speech signal including a plurality of subframes into a frequency domain and obtain frequency coefficients;

a magnitude quantization unit to transform magnitudes of the frequency coefficients for each of the subframes of the speech signal, quantize the transformed magnitudes and obtain magnitude quantization indices;

a sign quantization unit to quantize each sign of each of the frequency coefficients and obtain sign quantization indices; and a packetizing unit to generate the magnitude quantization indices and the sign quantization indices as a speech packet, wherein the frequency coefficients for each of the subframes are combined into a plurality of groups according to a time-varying property in energy of the speech signal and a two-dimensional transform is performed on each group according to the time-varying property of the speech signal, the frequency coefficients being combined into groups based on a uniformity of the subframes in relation to neighboring subframes.

2. The apparatus of claim 1, wherein the transform unit divides the speech signal into a plurality of subframes and transforms the speech signal into the frequency domain to obtain frequency coefficients for each of the subframes.

3. The apparatus of claim 1, wherein the transform unit outputs the frequency coefficients with a two-dimensional arrangement by two-dimensionally arranging subframe indices and frequency indices.

4. The apparatus of claim 1, wherein the magnitude quantization unit comprises:

a magnitude extractor to extract first coefficient magnitudes from the frequency coefficients;

a band divider to divide the first coefficient magnitudes into a plurality of frequency bands and obtain second coefficient magnitudes corresponding to each of the frequency bands;

a transformer to transform the second coefficient magnitudes and obtain third coefficient magnitudes;

a one-dimensional arrangement unit to one-dimensionally arrange the third coefficient magnitudes to obtain fourth coefficient magnitudes;

a DC value quantizer to quantize a DC value of the fourth coefficient magnitudes;

an RMS value quantizer to quantize RMS values of the fourth coefficient magnitudes;

a normalizer to normalize the fourth coefficient magnitudes using the quantized RMS values to obtain fifth coefficient magnitudes;

a magnitude quantizer to quantize the fifth coefficient magnitudes; and a bit allocator to allocate a number of bits for the magnitude quantizer.

5. The apparatus of claim 4, wherein the magnitude extractor extracts the first coefficient magnitudes, with a two-dimensional arrangement, from the frequency coefficients with the two-dimensional arrangement.

6. The apparatus of claim 4, wherein the band divider divides a frequency axis of the first coefficient magnitudes, with a two-dimensional arrangement, into the plurality of frequency bands.

7. The apparatus of claim 4, wherein the transformer transforms the second coefficient magnitudes with a two-dimensional arrangement to obtain the third coefficient magnitudes corresponding to each of the frequency bands.

8. The apparatus of claim 7, wherein the transformer performs a two-dimensional DCT.

9. The apparatus of claim 7, wherein if the second coefficient magnitudes with the two-dimensional arrangement have a size of N×P, where N denotes a number of subframes, and P denotes frequency coefficients corresponding to each of the frequency bands, the transformer divides the size of N×P into at least one two-dimensional arrangement in which at least one subframe is included, and performs a two-dimensional transform on each divided two-dimensional arrangement to obtain third coefficient magnitudes for each of the frequency bands.

10. The apparatus of claim 7, wherein the transformer variably selects a division type to divide the size of N×P into the at least one two-dimensional arrangement according to characteristics of the speech signal.

11. The apparatus of claim 4, wherein the one-dimensional arrangement unit obtains average energy of each of the third coefficient magnitudes and arranges the third coefficient magnitudes in an order of each of the obtained average energy.

12. The apparatus of claim 4, wherein the one-dimensional arrangement unit variably selects one of a plurality of arrangement conversion rules according to characteristics of the speech signal.

13. The apparatus of claim 4, wherein each of the DC value quantizer, the RMS value quantizer, and the magnitude quantizer separately quantizes the DC value and remaining values in the fourth coefficient magnitudes.

14. The apparatus of claim 4, wherein the magnitude quantizer does not quantize some coefficient magnitudes of the fifth coefficient magnitudes.

15. The apparatus of claim 4, wherein the bit allocator allocates bits on each of frequency indices and the allocated bits differ based on priorities of the frequency bands.

16. The apparatus of claim 1, wherein the sign quantization unit quantizes signs based on magnitude order information of the frequency coefficients provided by the magnitude quantization unit.

17. The apparatus of claim 16, wherein the sign quantization unit quantizes signs corresponding to coefficient magnitudes, up to a predetermined number, in the quantized coefficient magnitudes provided by the magnitude quantization unit.

18. A speech signal decompression apparatus, including at least one processing device comprising:

an inverse packetizing unit, using the at least one processing device, to inversely packetize a compressed speech packet and obtain sign quantization indices and magnitude quantization indices;

a sign dequantizer to dequantize the sign quantization indices that were obtained by quantizing each sign of each frequency coefficient obtained from a speech signal and coefficient signs;

a magnitude dequantizer to dequantize the magnitude quantization indices and obtain first coefficient magnitudes;

a two-dimensional arrangement unit to two-dimensionally arrange the first coefficient magnitudes to obtain second coefficient magnitudes;

a first inverse transformer to inversely transform the second coefficient magnitudes to obtain third coefficient magnitudes;

a sign insertion unit to insert signs into the third coefficient magnitudes and obtain frequency coefficients;

a subframe divider to divide the frequency coefficients into a plurality of subframes; and a second inverse transformer to inversely transform the frequency coefficients and obtain a time domain signal for each of the subframes, wherein the speech signal includes a plurality of subframes and the frequency coefficients for each of the subframes are combined into a plurality of groups according to a time-varying property in energy of the speech signal and a two-dimensional transform is performed on each group according to the time-varying property of the speech signal, the frequency coefficients being combined into groups based on a uniformity of the subframes in relation to neighboring subframes.

19. The apparatus of claim 18 further comprising a sign predictor to predict signs not comprised in the compressed speech packet.

20. A speech signal compression method comprising:

transforming a speech signal including a plurality of subframes into a frequency domain to obtain frequency coefficients;

transforming magnitudes of the frequency coefficients for each of the subframes of the speech signal and quantizing the transformed magnitudes to obtain magnitude quantization indices;

quantizing each sign of each of the frequency coefficients to obtain sign quantization indices; and generating the magnitude quantization indices and the signs quantization indices as a speech packet, wherein the frequency coefficients for each of the subframes are combined into a plurality of groups according to a time-varying property of the speech signal and a two-dimensional transform is performed on each group according to the time-varying property of the speech signal, the frequency coefficients being combined into groups based on a uniformity of the subframes in relation to neighboring subframes.

21. The method of claim 20, wherein the transforming of the speech signal further comprises dividing the speech signal into a plurality of subframes and transforming the speech signal into the frequency domain to obtain the frequency coefficients for each of subframes.

22. The method of claim 20, wherein in the transforming a speech signal further comprises obtaining the frequency coefficients with a two-dimensional arrangement by two-dimensionally arranging subframe indices and frequency indices.

23. The method of claim 20, wherein the transforming of the magnitudes of the frequency coefficients further comprises:

dividing first coefficient magnitudes extracted from the frequency coefficients into a plurality of frequency bands to obtain second coefficient magnitudes corresponding to each of the frequency bands, transforming the second coefficient magnitudes to obtain third coefficient magnitudes, and one-dimensionally arranging the third coefficient magnitudes to obtain fourth coefficient magnitudes;

quantizing a DC value of the fourth coefficient magnitudes;

quantizing RMS values of the fourth coefficient magnitudes;

normalizing the fourth coefficient magnitudes using the quantized RMS values to obtain fifth coefficient magnitudes;

quantizing the fifth coefficient magnitudes; and allocating a number of bits for the quantizing of the fifth coefficient magnitudes.

24. The method of claim 23, wherein the first coefficient magnitudes, with a two-dimensional arrangement, are extracted from the frequency coefficients with the two-dimensional arrangement.

25. The method of claim 23, wherein a frequency axis of the first coefficient magnitudes, with a two-dimensional arrangement, is divided into the plurality of frequency bands.

26. The method of claim 23, wherein the third coefficient magnitudes are obtained by performing a two-dimensional DCT on the second coefficient magnitudes, with a two-dimensional arrangement, for each of the frequency bands.

27. The method of claim 26, wherein if the second coefficient magnitudes, with the two-dimensional arrangement, have a size of N×P, where N denotes the number of subframes and P denotes frequency coefficients included in each of the frequency bands, the size of N×P is divided into at least one two-dimensional arrangement in which at least one subframe is included, and the two-dimensional transform is performed on each of the divided two-dimensional arrangements to obtain third coefficient magnitudes for each of the frequency bands.

28. The method of claim 23, wherein a division type to divide the size of N×P into the at least one two-dimensional arrangement is variably selected according to the time-varying property of the speech signal.

29. The method of claim 23, wherein average energy of each of the third coefficient magnitudes is obtained and the third coefficient magnitudes are arranged in an order of each of the obtained average energy.

30. The method of claim 23, wherein one of a plurality of arrangement conversion rules is variably selected according to of the time-varying property of the speech signal.

31. The method of claim 23, wherein in the quantizing of the DC value, the RMS value, and the fifth coefficient magnitudes, the DC value and remaining values are separately quantized in the fourth coefficient magnitudes.

32. The method of claim 23, wherein in the quantizing of the fifth coefficient magnitudes some of the fifth coefficient magnitudes are not quantized.

33. The method of claim 23, wherein in the allocating of the number of bits for the quantizing of the fifth coefficient magnitudes, differing bits are allocated on each of frequency indices based on priorities of the frequency bands.

34. The method of claim 20, wherein in the quantizing of signs of the frequency coefficients to obtain sign quantization indices, signs are quantized based on magnitude order information of the frequency coefficients.

35. The method of claim 34, wherein in the quantizing of signs of the frequency coefficients to obtain signs quantization indices, signs are quantized corresponding to coefficient magnitudes, up to a predetermined number, in the quantized coefficient magnitudes.

36. A speech signal decompression method comprising:

inversely packetizing a compressed speech packet to obtain sign quantization indices and magnitude quantization indices;

dequantizing the sign quantization indices that were obtained by quantizing each sign of each frequency coefficient obtained from a speech signal and coefficient signs;

dequantizing the magnitude quantization indices to obtain first coefficient magnitudes;

two-dimensionally arranging the first coefficient magnitudes to obtain second coefficient magnitudes;

inversely transforming the second coefficient magnitudes to obtain third coefficient magnitudes;

inserting signs into the third coefficient magnitudes to obtain frequency coefficients;

dividing the frequency coefficients into a plurality of subframes; and inversely transforming the frequency coefficients to obtain a time domain signal for each of the subframes, wherein the speech signal includes a plurality of subframes and the frequency coefficients for each of the subframes are combined into a plurality of groups according to a time-varying property in energy of the speech signal and a two-dimensional transform is performed on each group according to the time-varying property of the speech signal, the frequency coefficients being combined into groups based on a uniformity of the subframes in relation to neighboring subframes.

37. The method of claim 36 further comprising predicting signs not comprised in the compressed speech packet.

38. A computer-readable non-transitory medium encoded with instructions capable of being executed on a computer and implementing a speech signal compression method, comprising:

transforming a speech signal including a plurality of subframes into a frequency domain to obtain frequency coefficients;

transforming magnitudes of the frequency coefficients for each of the subframes of the speech signal and quantizing the transformed magnitudes to obtain magnitude quantization indices;

quantizing each sign of each of the frequency coefficients to obtain sign quantization indices; and generating the magnitude quantization indices and the sign quantization indices as a speech packet, wherein the frequency coefficients for each of the subframes are combined into a plurality of groups according to a time-varying property in energy of the speech signal and a two-dimensional transform is performed on each group according to the time-varying property of the speech signal, the frequency coefficients being combined into groups based on a uniformity of the subframes in relation to neighboring subframes.

39. A computer-readable non-transitory medium encoded with instructions capable of being executed on a computer and implementing a speech signal decompression method, comprising:

inversely packetizing a compressed speech packet to obtain sign quantization indices and magnitude quantization indices;

dequantizing the sign quantization indices that were obtained by quantizing each sign of each frequency coefficient obtained from a speech signal and coefficient signs;

dequantizing the magnitude quantization indices to obtain first coefficient magnitudes;

two-dimensionally arranging the first coefficient magnitudes to obtain second coefficient magnitudes;

inversely transforming the second coefficient magnitudes to obtain third coefficient magnitudes;

inserting signs into the third coefficient magnitudes to obtain frequency coefficients;

dividing the frequency coefficients into a plurality of subframes; and inversely transforming the frequency coefficients to obtain a time domain signal for each of the subframes, wherein the speech signal includes a plurality of subframes and the frequency coefficients for each of the subframes are combined into a plurality of groups according to a time-varying property in energy of the speech signal and a two-dimensional transform is performed on each group according to the time-varying property of the speech signal, the frequency coefficients being combined into groups based on a uniformity of the subframes in relation to neighboring subframes.

* * * * *

UNITED STATES PATENT AND TRADEMARK OFFICE

CERTIFICATE OF CORRECTION

PATENT NO. : 8,019,600 B2
APPLICATION NO. : 11/128432
DATED : September 13, 2011
INVENTOR(S) : Son et al.

It is certified that error appears in the above-identified patent and that said Letters Patent is hereby corrected as shown below:

Title Page Item (75) Column 1, Line 5, Delete "Youngyo" and insert --Youngvo--, therefor.

Column 14, Line 29, In Claim 22, after "wherein" delete "in".

Column 15, Line 17 (Approx.), In Claim 30, after "to" delete "of".

Signed and Sealed this
Seventh Day of February, 2012

David J. Kappos

David J. Kappos
*Director of the United States Patent and Trademark Office*